United States Patent [19]

Baus

[11] 4,386,447

[45] Jun. 7, 1983

[54] SUSPENSION DEVICE FOR A SLIDING WALL PANEL OF A SLIDING PARTITION

[76] Inventor: Heinz G. Baus, Wartbodenstrasse 35, CH-3626 Huenibach-Thun, Switzerland

[21] Appl. No.: 183,737

[22] Filed: Sep. 3, 1980

Related U.S. Application Data

[63] Continuation-in-part of Ser. No. 132,329, Mar. 20, 1980, abandoned.

[30] Foreign Application Priority Data

Mar. 26, 1979 [DE] Fed. Rep. of Germany ..... 2911875

[51] Int. Cl.[3] ..... E05D 13/02

[52] U.S. Cl. ..... 16/105

[58] Field of Search ..... 16/105, 99, 102, 87 R; 49/409

[56] References Cited

U.S. PATENT DOCUMENTS

| | | | |
|---|---|---|---|
| 949,076 | 2/1910 | Jacobs | 16/105 |
| 1,192,966 | 8/1916 | Willard | 16/105 |
| 1,832,050 | 11/1931 | Pitcher . | |
| 2,617,141 | 11/1952 | Sterling | 16/105 |
| 3,371,372 | 3/1968 | Banse | 16/105 |
| 3,512,209 | 5/1970 | Povoder . | |

FOREIGN PATENT DOCUMENTS

| | | |
|---|---|---|
| 623021 | 1/1963 | Belgium . |
| 72024 | 11/1914 | Fed. Rep. of Germany . |
| 522745 | 4/1931 | Fed. Rep. of Germany . |
| 524405 | 5/1931 | Fed. Rep. of Germany . |
| 710243 | 7/1941 | Fed. Rep. of Germany . |
| 1802377 | 8/1959 | Fed. Rep. of Germany . |
| 1260728 | 2/1968 | Fed. Rep. of Germany . |
| 1708277 | 5/1971 | Fed. Rep. of Germany . |
| 2455399 | 5/1975 | Fed. Rep. of Germany . |
| 7530741 | 1/1976 | Fed. Rep. of Germany . |
| 2555889 | 10/1976 | Fed. Rep. of Germany . |
| 2554098 | 6/1977 | Fed. Rep. of Germany . |
| 2747480 | 11/1978 | Fed. Rep. of Germany . |
| 764058 | 5/1934 | France . |
| 247813 | 12/1947 | Switzerland . |
| 309138 | 11/1955 | Switzerland . |
| 512658 | 9/1971 | Switzerland . |
| 326851 | 3/1930 | United Kingdom . |
| 411454 | 6/1934 | United Kingdom . |
| 529003 | 11/1940 | United Kingdom . |
| 903917 | 8/1962 | United Kingdom . |
| 918797 | 2/1963 | United Kingdom . |
| 1405931 | 9/1975 | United Kingdom . |
| 1509435 | 5/1978 | United Kingdom . |
| 1561849 | 3/1980 | United Kingdom . |

*Primary Examiner*—Peter P. Nerbun

*Attorney, Agent, or Firm*—Schwartz, Jeffery, Schwaab, Mack, Blumenthal & Koch

[57] ABSTRACT

A suspension device for a sliding wall panel of a sliding partition, in particular for humid rooms, having at least one roller adjustably mounted on the frame of the wall panel and capable of rolling in the installed state of the wall panel on a guide rail. At least one chamber is arranged in the frame, the chamber being open in the upward direction and housing an adjusting cylinder. The adjusting cylinder stands vertically and has an internal threading, which is engaged by a supporting element by means of external threads, the supporting element being secured against rotation and bearingly connected on top with the roller, so that the supporting element may be moved up and down by rotating the adjusting cylinder. An extension in the form of a pin is provided on the supporting element; it extends through and beyond the adjusting cylinder in the axial direction and engages a blind hole in the lower surface of the chamber. The adjusting cylinder is accessible through a window, which may be closed by a cover cap which engages the adjusting cylinder to prevent rotation thereof.

22 Claims, 6 Drawing Figures

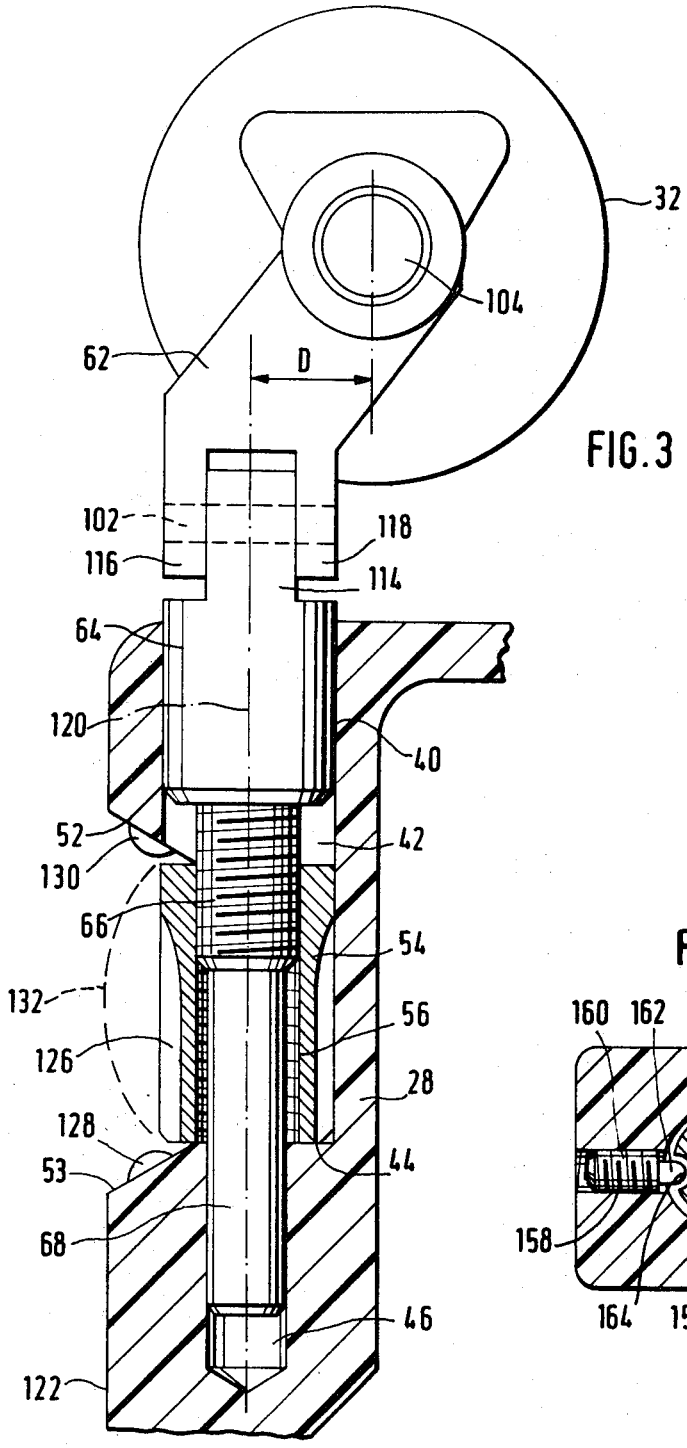
FIG. 3
FIG. 4
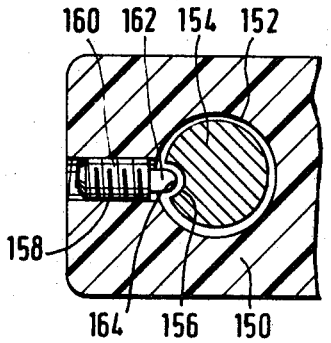

SUSPENSION DEVICE FOR A SLIDING WALL PANEL OF A SLIDING PARTITION

This application is a continuation-in-part of copending U.S. Application Ser. No. 132,329, filed Mar. 20, 1980 now abandoned.

The invention concerns a suspension device for a sliding wall panel of a sliding partition, particularly for humid rooms, with at least one roller adjustably mounted on the frame of the wall panel, capable of rolling along a guide rail when the wall panel is installed, wherein at least one chamber is arranged in the frame, the chamber being open in the upward direction by virtue of an opening, with an adjusting element being arranged in said chamber, having a generally vertical axis and with the adjusting element being provided at least in its upper end region with internal threads, wherein a support element, mounted against rotation and supportingly connected at the top with the roller, engages by means of its external threading, so that the support element may be moved upwardly and downwardly by rotating the adjusting element.

Suspension devices of this type are preferably used in sliding partitions arranged at the edge of a bath or shower tub. The wall panels of the sliding partition are provided with a translucent panel set in a frame. The suspension device of the type described hereinabove is located in the upper area of the frame.

A problem frequently encountered in the construction industry is the fact that certain dimensions, because of the relatively large tolerances, can never be accurately maintained. For this reason, it is often convenient when the distance of the roller or rollers to the upper edge of the frame of a wall panel is adustable. According to the invention, the adjusting element is therefore designed as an adjusting cylinder engaging a pin-like extension provided on the supporting element, the extension passing through the adjusting cylinder in the axial direction and extending past the latter, into a blind hole in the lower surface of the chamber.

The suspension device according to the invention is characterized by a particularly simple construction. It comprises two parts, arranged inside the frame, whereby the danger of its becoming fouled with soil is reduced. Adjustments are also very simple; it is only necessary to rotate the adjusting cylinder in order to effect the insertion or retraction of the supporting element into or out of the frame. The mounting of the suspension device on the frame of the doors, i.e. the application of the suspension device to the door frame, is also simplified: the adjusting cylinder is first placed into the chamber, and the supporting element is inserted from above into the opening until the external threads of the supporting element engage the internal threads of the adjusting cylinder. By rotating the adjusting cylinder, the supporting element is further drawn into the opening.

In order to assure the troublefree guidance of the suspension device and to avoid canting during the rotation of the adjusting cylinder, the pin-like extension is provided. In this manner, the suspension device is guided at the top within the guiding area of the supporting element and at the bottom, beneath the adjusting cylinder, in the area of the pin. The pin and the blind hole may be circular in their configuration or they may having a cross section other than circular. The circular cross section is easier to produce, while a noncircular cross section prevents the turning of the supporting element.

As mentioned hereinabove, the suspension device according to the invention is applied in particular to shower partitions. Such shower partitions are installed in so-called wet or humid rooms, so that during adjustments the adjusting cylinder may be wet. For this reason, it is of advantage to provide the adjusting cylinder with a roughened, knurled outer surface, thus significantly increasing the friction coefficient between the surface of the hand and the adjusting cylinder. In place of knurling, notches or slits may also be provided. It is possible further to place a plurality of blind holes on the outside of the adjusting cylinder, transversely to its longitudinal axis and distributed regularly over its circumference, such that an elongated, pin-like tool is insertable into the holes, to facilitate rotation of the adjusting cylinder. This measure is not absolutely necessary and manual adjustments without tools are preferable.

In order to prevent the rotation of the supporting element during the adjustment or rotation of the adjusting cylinder, and to render it fixed against rotation, the opening preferably has internal dimensions other than circular and the supporting element is adapted in its external configuration, within the guidance region penetrating the opening, to the internal dimensions of the opening. In this manner, adequate security against rotation is obtained; however, both the supporting element and the opening may have round cross sections, if security against rotation is assured by noncircular configurations of the pin and the blind hole.

In a preferred embodiment, both the supporting element and the opening have square cross sections. Naturally, they may also be rectangular or, when necessary, be provided with a polygonal cross section. It is further possible to design the supporting element with an essentially circular cross section, having a longitudinal groove on the portion of its outer surface which penetrates into the opening which in turn is engaged by a pin mounted in a direction transverse to the opening, on the corner joint. This pin may be arranged at the end of a threaded bolt that may be screwed from the outside through the corner joint into the opening. This provides security against rotation and may also serve to immobilize or clamp the supporting element.

In order to render the adjusting cylinder accessible from the outside, the chamber is equipped with a window, opening outwardly in a direction perpendicular to the longitudinal axis of the chamber. It is preferred to provide the window at the narrow edge of the corner joint; it is naturally also possible to have the chamber open on one or both sides transversely to the plane of the wall panel. The latter possibility, i.e., to provide a window on both sides, is advantageous when the supporting part is guided both at the top and at the bottom. In such a case, adjustments may be made from both sides with one hand.

In order to make the bearing or contact surface, respectively, of the adjusting cylinder adequately large, the window may be flared outwardly.

The suspension device or devices are generally found at the end of the wall panel, because the windows to manipulate the adusting cylinder are conveniently located at the narrow side edges. To prevent the impact of the roller, during sliding, against a stop prior to the tight abutment of the narrow side edge against the appropriate frame of the partition, the portion of the supporting element extending outwardly of the opening is advantageously bent or angled away from the narrow side edge, with the bending angle and the length of the bent section being such that the leading edge of the guide extends no further than the projections of the narrow side edge.

The suspension device according to the invention has a further improvement which may be applied not only to the adjustable suspension device according to the invention, but may find general use. The supporting element comprises a hinged joint having a hinge axis aligned in the direction of the sliding motion of the sliding partition. This subdivides the supporting element into a bearing part carrying the roller and a supporting part. The hinge axis may be located within or without the plane of the wall panel. This essentially depends on the design layout of the wall panel. By virtue of the hinge, it is possible to swing the wall panel upwardly and inwardly for improved access to the wall panel and the areas contacting and guiding the lower side of the wall panel. In particular, these lower areas are readily exposed to dirt, requiring frequent cleaning. Such cleaning is facilitated by swinging the wall panel upwardly. To prevent the swinging of individual wall panels transversely to the plane of the panel in normal use, bottom guidance may be effected by means of magnets, as described in German laid-open Application No. DE-AS No. 25 54 098. It is further possible to effect the bottom guidance by means of a U-shaped guide rail engaged by the wall panel from above, with the inner leg downwardly foldable (see also German laid-open Application No. DE-AS No. 27 47 480).

In an advantageous embodiment of the invention, the supporting element may comprise a supporting part, and a bearing part carrying the roller and connected with the supporting part by means of the hinged joint, and the hinged joint being formed by transverse bores provided in projections on both the bearing part and the supporting part. The projections on the bearing part and the supporting part are aligned with respect to each other, so that their transverse bores are coaligned when the hinged joint is assembled, permitting the hinge pin to be inserted through both of them. Two projections may be provided on the bearing part and one on the supporting part, the latter fitting, when the hinged joint is assembled, between the two projections on the bearing part.

Preferred embodiments of the invention are explained below with the aid of the drawings.

In the drawings:

FIG. 3 shows a cross-section through a suspension device parallel to the plane of the wall panel;

FIG. 4 shows a view of a section parallel to the upper edge of the frame with the representation of a guide with a bolt;

Figure 1:
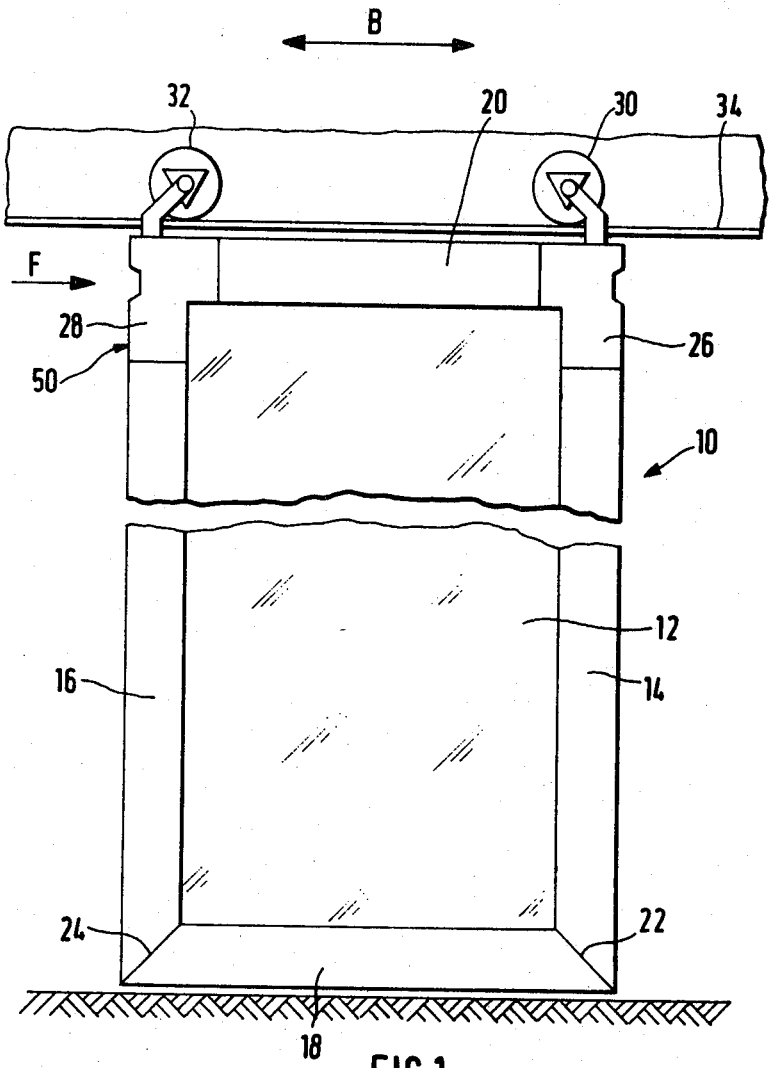
FIG. 1 shows a side elevation of a wall panel for a sliding wall with suspension devices attached to the respective ends of the upper part of the frame.

FIG. 1 shows a side elevation of a wall panel 10. The wall panel 10 consists of a translucent sheet 12, edged by the frame parts 14, 16, 18 and 20. Parts 14 and 16 of the frame are connected with part 18 of the frame by means of a mitered joint 22 and 24, respectively. The two parts 14 and 16 of the frame are joined with upper part 20 of the frame by means of corner joints 26 and 28, to which, pointing in the upward direction, the suspension device of the invention is secured. The suspension devices have respective rollers 30, 32, capable of rolling on a guide rail 34 in the direction of the double arrow B.

Figure 2:
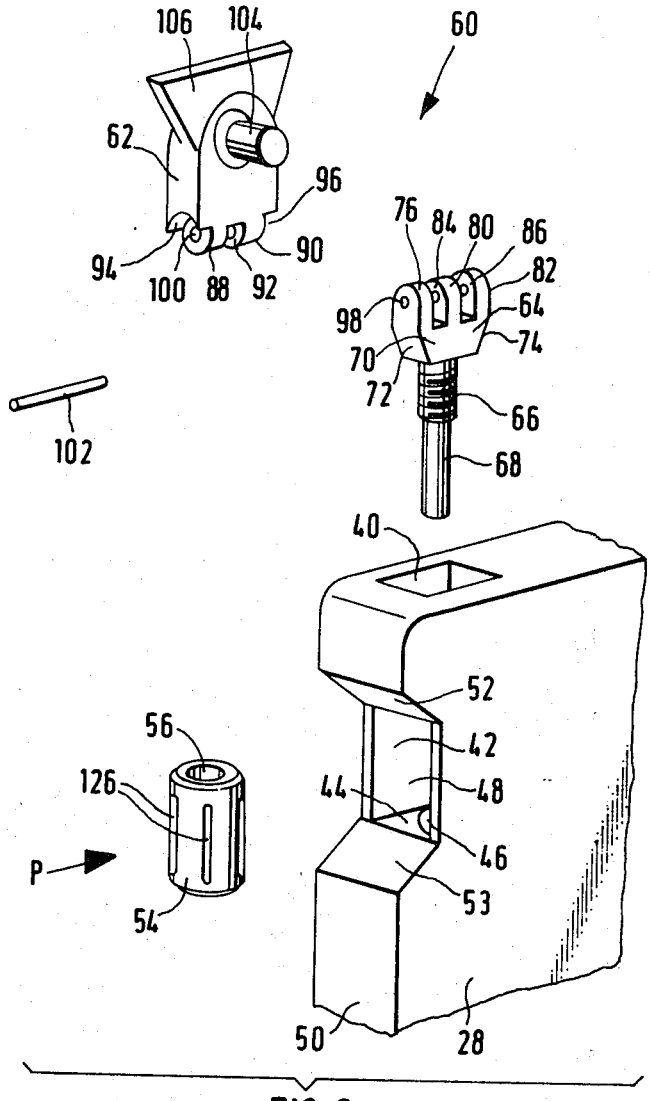
FIG. 2 shows a perspective view of a suspension device according to the invention, in an exploded view.

FIG. 2 shows a perspective partial view of the corner joint 28 taken in the direction of arrow F. A generally vertical opening 40 is seen, the opening communicating with a chamber 42 in the downward direction, while a blind hole 46 is provided in the bottom 44 of the chamber 42. The chamber 42 opens outwardly through a window 48 provided within the area of narrow side edge 50. The window 48 flares outwardly with the flare defined by bevelled surfaces 52 and 53 which form a V. An adjusting cylinder 54 is provided in chamber 42, cylinder 54 having internal threads 56. Adjusting cylinder 54 is placed into the chamber 42 in the direction of the arrow P.

A supporting element 60 is seen above the corner joint 28, comprising a bearing part 62 and the supporting part 64. The supporting part 64 is equipped with external threads 66 and, extending beyond the external threads 66, a pin 68. Above the threaded section 66 there is a guide region 70, with the external cross section thereof being adapted to the internal cross section of the opening 40. The bearing part 64 narrows toward the external threading 66 by way of the bevelled surfaces 72 and 74, which assist in the introduction of the bearing part 64 into the opening 40. The upper end of the bearing part 64 has three projections 76, 80 and 82, having rounded cross sections and intervals 84 and 86 between them.

The bearing part 62 has an external cross section corresponding to the external cross section of the guide region 70 of supporting part 64. Two projections 88 and 90 are provided at the lower end of the bearing part, constructed to engage the intervals 84 and 86. An interval (recess) 92 is bounded by the projections 88 and 90, which are located adjacent recesses 88 and 96, the latter having base areas or bottom areas shaped in a circular concave manner. The base or bottom surfaces of the other intervals or recesses (92, 84, 86) are also shaped in a circular concave manner, as illustrated for recess 94. The projections 76, 80 and 82 and the projections 88 and 90 all have through holes 98 and 100, which are aligned with each other when the bearing part 62 is inserted with its projections in the intervals 84 and 86. A hinge pin 102 may be inserted through the mutually aligned openings or through holes 98 and 100. The hinge pin 102 is shown enlarged in FIG. 2 in order to represent it more clearly.

The upper region of bearing part 62 is provided on both sides with journal pins extending perpendicularly to the direction of the hinge pin 102, only one journal pin (104) being visible in the drawing. Bearing part 62 is closed off in the upward direction by an outwardly flared shoulder 106. During assembly, the supporting element 60, composed of parts 62, 64 and 102, is introduced from above through opening 40 into chamber 42, after adjusting cylinder 54 has been inserted through window 48 into chamber 42. The pin 68 passes through the internal threads 56, and (not shown) continues downwardly beyond the adjusting cylinder. Upon further insertion, pin 68 passes through the adjusting cylinder 54 and extends into the blind hole 46. After the external threading 66 engages the internal threads 56, the supporting element 60 may be drawn into the opening 40 by rotating the adjusting cylinder 54. The supporting element 60 is prevented from rotating by the rectangular configuration of the opening 40 and the supporting part 64. Furthermore, due to guidance in the area of the opening 40 and guidance in the area of the blind hole 46, tilting of the device is eliminated during rotation of adjustable cylinder 54.

FIG. 3 shows a suspension device in greater detail than in FIG. 2. The corner joint 28 may be seen, which is provided with the chamber 42, which in turn is open in the upward direction by virtue of the opening 40. It is seen in FIG. 3 that it is not necessary to expand chamber 42 with respect to opening 40. The adjusting cylinder 54 may also be seen; the internal threads 56 extending over its entire height. A blind hole 46 is arranged in the bottom 44 of the chamber 42. The supporting element 60, comprising the bearing part 62, the supporting part 64 and the hinge pin 102, extends through opening 40, through adjusting cylinder 54, and into blind hole 46. The external threads 66 and the pin 68 are located on the support part 64, with external threads 66 engaging internal threads 56 of adjusting cylinder 54. In contrast to FIG. 2, the supporting part 64 of FIG. 3 does not have three adjacent projections, but merely one projection 114, extending between two projections 116 and 118, which form a fork; as the through holes and the configuration of the hinged joint are similar to the hinged joint of FIG. 2, detailed description is unnecessary.

The guiding area of the supporting part 64 here is square in its cross section, and opening 40 is also square. The length of the sides of the square are equal to the external diameter of cylinder 54.

The bearing part 62 is offset in the rearward direction, so that the center axis of the journal pin 104 is at a distance D from the center axis 120 of supporting part 60, from the edge of the narrow side 122 of the corner joint 28. This results in the fact that the roller 32 does not project past the edge 122 of the narrow side. (This offset is not shown in FIG. 2.)

It can be seen that the adjusting cylinder 54 has notches 126 on its external circumference, which enhances adjustability of the adjusting cylinder.

Respective cams 128 and 130 are formed on the bevelled surfaces 52 and 53 leading to window 48, so that a cover cap 132 (shown by a broken line) may be clipped behind the cams. The cap may carry a pin extending into a notch 126 in cylinder 54, in order to arrest the latter in its adjusted position.

A suspension device may be mounted on each of the corner joints 28 and 26; it is also possible to manufacture the frame part 16 with corner joint 28 and the frame part 14 with corner joint 26, respectively, in a single piece, or, the frame part 20 may be made as a single piece integral with the two corner joints 26 and 28.

The location of the window 48 on the narrow side edges 50 and 122, respectively, has the advantage that adjustments may be effected from the outside (i.e. while standing outside the humid room) or from the inside (i.e. while standing inside the humid room). It is of course also possible to make the corner joint wider in the direction of the plane of the wall panel so that the window may open both outwardly and inwardly. It is then possible to adjust the device from both sides (i.e. when standing either outside or inside the humid room) or to actuate the adjusting cylinder with two fingers acting against each other.

Another guide arrangement is shown in FIG. 4. A cross section through a corner joint 150, corresponding to the corner joint 28, is shown having a circular opening 152 which in turn corresponds to the opening 40 of FIGS. 2 and 3. This circular opening engages the guide section of the supporting element 154, which is provided with a longitudinal (vertical) groove 156 in the guide region. The corner joint 150 has a horizontal bore 158 equipped with internal threads, to receive a threaded bolt 160. The latter may consist of a slotted screw or a hexagonal cap screw. A pin 162 is provided at the inner end of the bolt 160, which engages the longitudinal groove 156. In FIG. 4 this pin is shown to have a rounded front tip 164, but it may alternatively be provided with a conical tip. Then, if all of the elements of the suspension device are made of a synthetic material, the arrangement of FIG. 4 provides not only protection against a rotating motion of the supporting element 154, but also against axial displacement, because the conical tip penetrates into the supporting element 154 to thus additionally preventing axial sliding, which is particularly important when the longitudinal dimensions of the adjusting cylinder 54 and the chamber 42 exhibit excessive, unfavorable tolerances.

Figure 5:
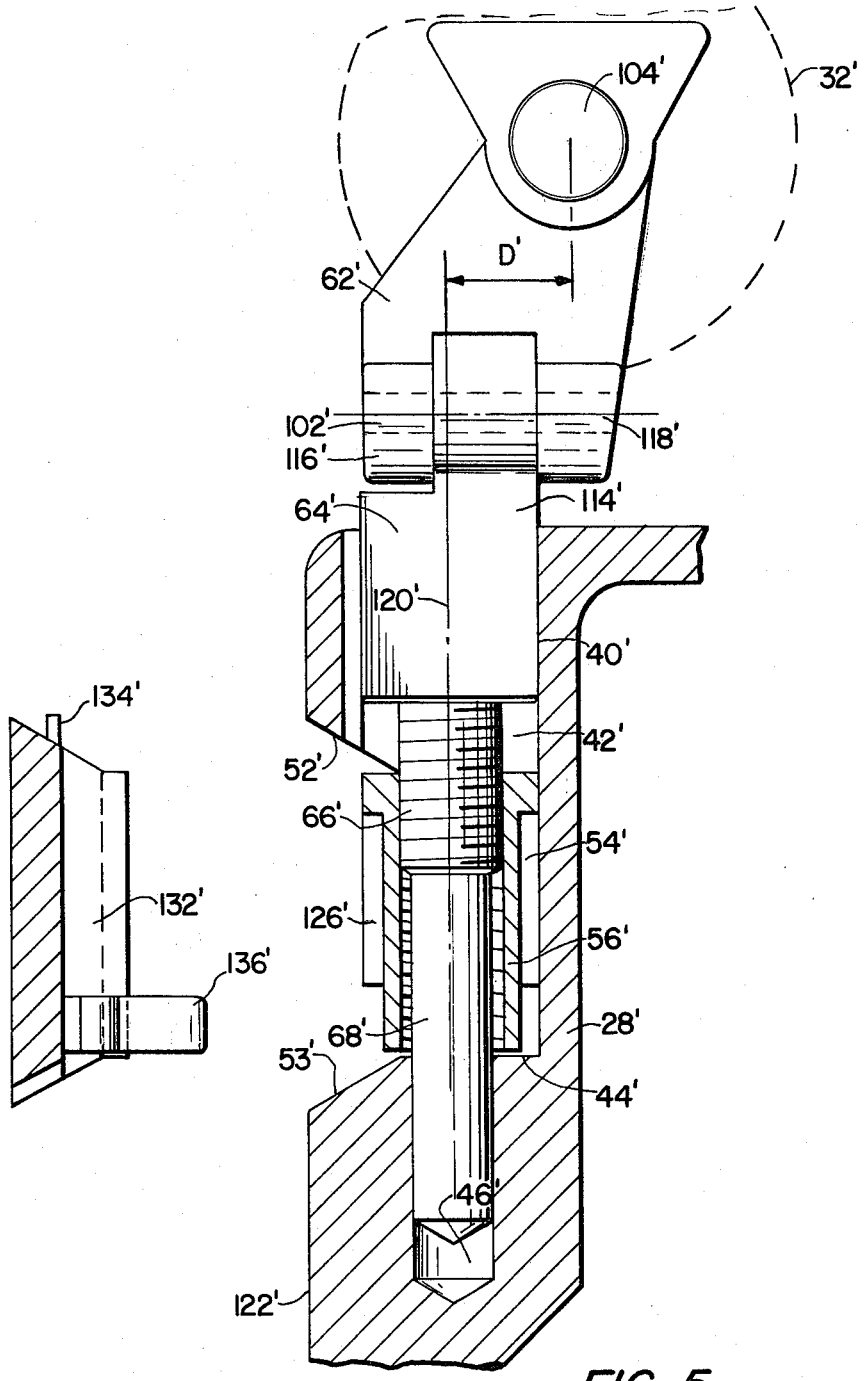
FIG. 5 shows a cross-section through a suspension device according to the invention, parallel to the plane of the wall panel.
Figure 6:
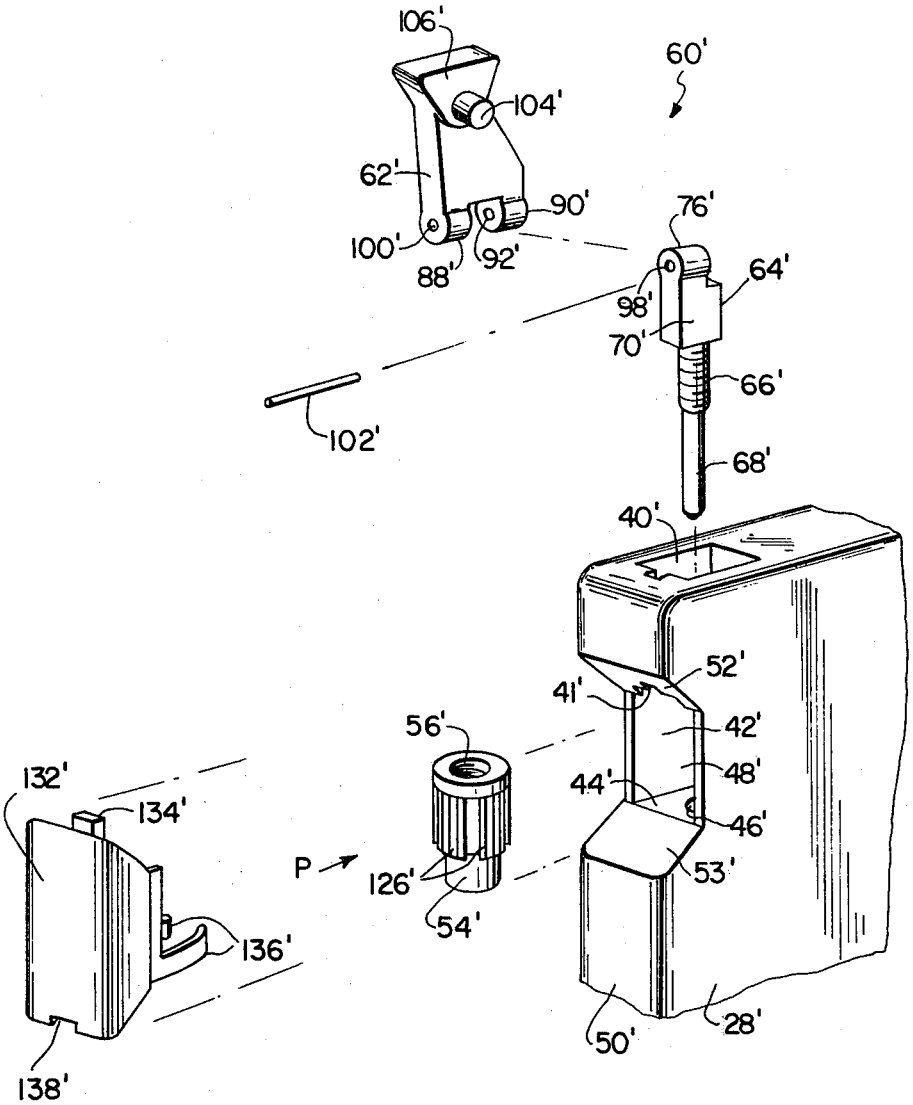
FIG. 6 shows an exploded perspective view of the suspension device of FIG. 5.

FIGS. 5 and 6 show a further embodiment of a corner joint 28'. FIG. 6 shows the corner joint 28' in perspective partial view, taken in the direction of arrow F of FIG. 1. A generally vertical opening 40' communicates with a chamber 42', while a blind hole 46' is provided in the bottom 44' of chamber 42'. Chamber 42' opens outwardly through a window 48' provided within the area of narrow side edge 50'. Window 48' flares outwardly, with the flare defined by bevelled surfaces 52' and 53'. An adjusting cylinder 54' is provided in chamber 42', cylinder 54' having internal threads 56'. Adjusting cylinder 54' is inserted in chamber 42' in the direction of arrow P.

A supporting element 60' is shown in exploded perspective view above corner joint 28', and comprises a bearing part 62' and a supporting part 64'. Supporting part 64' is provided with external threads 66' and, extending beyond the external threads 66', a pin 68'. Above threaded section 66' is a guide region 70' having a rectangular cross section adapted to the internal cross section of opening 40'. The upper end of bearing part 64' has a rounded projection 76'.

Bearing part 62' has two projections 88' and 90' which engage projection 76'. An interval (recess) 92' is bounded by projections 88' and 90'. Projections 76', 88' and 90' have respective through holes 98', 100', which are aligned with one another when the bearing part 62' is mated with bearing part 64'. A hinge pin 102' may be force-fit into the mutually aligned through holes 98' and 100'.

The upper region of bearing part 62' is provided on both sides with journal pins extending perpendicularly to the direction of hinge pin 102', only one journal pin 104' being visible in each of FIGS. 5 and 6. Bearing part 62' is closed off in the upward direction by an outwardly flared shoulder 106'.

During assembly, the supporting element 60', composed of parts 62', 64' and 102', is introduced from above through opening 40' into chamber 42', after adjusing cylinder 54' has been inserted through window 48' into chamber 42'. The pin 68' passes through the internal threads 56', and passes through adjusting cylinder 54' and into blind hole 46'. The supporting element 60' may be drawn further into the opening 40' by rotating the adjusting cylinder 54'. Supporting element 60' is prevented from rotating by the rectangular configuration of opening 40' and of supporting part 64'. Further, since supporting part 64' is guided in the area of the opening 40' by pin 68' extending into blind hole 46', supporting part 64' cannot tilt during rotation of adjustable cylinder 54'.

FIG. 5 shows in partial cross sectional view the suspension device of FIG. 6 in the assembled state. As is clearly seen in FIG. 5, bearing part 62' is offset from the edge of the narrow side 122' of corner joint 28' so that the center axis of journal pin 104' is spaced at a distance D' from the center axis 120' of supporting part 60'. As a result, the roller 32' will not project past the edge 112' of the narrow side 50'.

As can be seen from FIGS. 5 and 6, adjusting cylinder 54' has notches 126' on the upper portion of its external circumference, enhancing adjustability of the adjusting cylinder. A lower portion of adjusting cylinder 54' has a smooth outer surface. A cover cap 132' is provided, which preferably has an upwardly extending pin 134' dimensioned to engage a groove 41' in opening 40'. Cover cap 132' also has resilient arms 136' which are curved slightly inwardly toward one another, so that the cover cap may be snapped into place with pin 134' engaging groove 41' and arms 136' resiliently engaging the lower, smooth outer portion of adjusting cylinder 54'. A small recess 138' may be provided in the lower outer surface of cover cap 132', to permit insertion of a prying device for removing the cover cap when the adjusting cylinder is to be rotated. It will be understood that the resilient arms 136' of the cover cap snugly engage adjusting cylinder 54' to prevent rotation thereof when the cover cap is installed. Cover cap 132' preferably has upper end lower bevelled surfaces which mate with surfaces 52', 53' of corner joint 28'. With cover cap 132' in place, the assembled suspension device presents a finished appearance, with no significant openings which will collect dirt and grime.

Those of skill in the art will recognize that further modifications of the described embodiments may be made within the scope and spirit of the present invention, which is defined by the following claims.

I claim:

1. A suspension device for a sliding wall panel of a sliding partition, in particular for humid rooms, the wall panel having a frame with an upper edge, comprising:

at least one roller, capable of rolling on a guide rail;

at least one chamber in the upper edge of the frame, the chamber being open upwardly through a first chamber opening and having a second chamber opening at the bottom thereof which is formed as a downwardly extending blind hole, said chamber further having a lateral window in one side thereof which opens outwardly in a direction perpendicular to the directions of said first and second openings;

a rotatable adjusting cylinder housed in said chamber, said adjusting cylinder having a vertically oriented central bore with internal threads at least at an upper end portion of the bore and being accessible from outside said panel through said lateral window; and a supporting element on which said roller is rotatably mounted, the supporting element having a downwardly extending pin-like projection, wherein the projection has external threads engaging the internal threads of the adjusting cylinder bore and wherein the projection extends through said first opening, through the adjusting cylinder in said chamber, and through said second opening into the blind hole, at least a portion of said supporting element and at least one of said first and second guide openings having respective guide regions of polygonal cross-section which slidably engage one another to prevent rotation of said supporting element when said adjusting cylinder is rotated;

whereby the supporting element and roller mounted thereon are vertically adjustable with respect to the wall panel by rotating the adjusting cylinder.

2. A suspension device according to claim 1, wherein the blind hole and the portion of the pin-like projection engaging the blind hole have non-circular cross-sections.

3. A suspension device according to claim 1, wherein the blind hole and the portion of the pin-like projection engaging the blind hole have circular cross-sections.

4. A suspension device according to claim 1, wherein the adjusting cylinder has an outer surface roughened by knurling or the like.

5. A suspension device according to claim 1, wherein the adjusting cylinder has an outer surface with notches or slits therein.

6. A suspension device according to claim 1, wherein the adjusting cylinder has an outer surface provided with a plurality of blind holes distributed regularly over its circumference and arranged transversely to the bore, whereby an elongated tool is insertable into the blind holes for the purpose of rotating the adjusting cylinder.

7. A suspension device according to one of claims 1 to 6, wherein the supporting element and the first chamber opening have respective guide regions of polygonal cross-section which slidably engage one another to prevent rotation of the supporting element when the adjusting cylinder is rotated.

8. A suspension device according to one of claims 1 to 6, wherein the supporting element and the chamber opening have respective guide regions of generally circular cross-section, the supporting element guide region having a longitudinally extending groove in its external circumference, further comprising a pin mounted in the frame and extending transversely into the chamber opening to engage the groove in the supporting element and prevent rotation of the supporting element when the adjusting cylinder is rotated.

9. A suspension device according to claim 8, wherein the pin comprises a threaded bolt engaging and capable of being screwed into the frame.

10. A suspension device according to one of claims 1 to 6, wherein the frame further has narrow slide edges and said lateral window is located at a narrow side edge of the frame.

11. A suspension device according to claim 10, further comprising a removable cover cap closing off the window.

12. A suspension device according to one of claims 1 to 6, wherein the frame further has narrow side edges and wherein the supporting element has an upper bearing part, on which the roller is mounted, with an offset from a lower supporting part of the supporting element, the angle and length of the offset being such that the roller extends not further than the projection of the narrow side edges of the frame.

13. A suspension device according to one of claims 1 to 6, wherein the supporting element comprises an upper bearing part and a lower supporting part connected by a hinge joint, the hinge joint having a hinge pin aligned with the direction in which the sliding wall panel is slidable.

14. A suspension device according to claim 13, wherein the hinge pin lies in a common plane with the wall panel.

15. A suspension device according to claim 13, wherein said roller is mounted on said upper bearing part, and said hinge joint comprises projections integrally formed with the upper bearing part and the lower supporting part and having transverse bores, whereby the projections may be aligned for insertion of the hinge pin through the transverse bores.

16. A suspension device according to claim 15, wherein two of the projections are integrally formed on the bearing part and three of the projections are integrally formed on the supporting part, each projection on the bearing part interposed between two projections on the supporting pin when the hinge pin is inserted.

17. A suspension device according to claim 15, wherein the hinge pin is retained fixedly in the axial direction by means of, for example, cotter pins.

18. A suspension device according to claim 1, wherein at least a first end portion of the outer circumferential surface of said adjusting cylinder is provided with radially protruding members which facilitate manual rotation of the adjusting cylinder.

19. A suspension device according to claim 18, wherein a second end portion of the outer circumferential surface of said adjusting cylinder is relatively smooth.

20. A suspension device according to claim 20, wherein said frame further has narrow side edges and the chamber is further provided with a window opening outwardly from the chamber, located at a narrow side edge of the frame.

21. A suspension device according to claim 20, further comprising a removable cover cap closing off said window, said removable cover cap having a pair of resilient arms curved inwardly to grippingly engage said smooth outer circumferential surface portion of said adjusting cylinder, and thereby frictionally oppose rotation of the adjusting cylinder when the cover cap is installed.

22. A suspension device according to claim 21, wherein said cover cap includes a pin which engages a corresponding groove in an edge portion of said chamber.

* * * * *